US007540590B2

(12) United States Patent
Chen

(10) Patent No.: US 7,540,590 B2
(45) Date of Patent: Jun. 2, 2009

(54) INK CARTRIDGE AND LOADING MECHANISM FOR INK CARTRIDGE

(75) Inventor: Chun-Jin Chen, Hsinchu (TW)

(73) Assignee: Lite-On Technology Corporation, Taipei (TW)

( * ) Notice: Subject to any disclaimer, the term of this patent is extended or adjusted under 35 U.S.C. 154(b) by 552 days.

(21) Appl. No.: 11/360,575

(22) Filed: Feb. 24, 2006

(65) Prior Publication Data

US 2007/0097192 A1 May 3, 2007

(30) Foreign Application Priority Data

Oct. 21, 2005 (TW) ..... 94136967 A

(51) Int. Cl.
*B41J 2/14* (2006.01)

(52) U.S. Cl. ..... 347/49

(58) Field of Classification Search ..... 347/49, 347/50, 86, 87

See application file for complete search history.

(56) References Cited

U.S. PATENT DOCUMENTS 4,872,026 A * 10/1989 Rasmussen et al. ..... 347/56
5,579,039 A * 11/1996 Kurata et al. ..... 347/49
5,731,829 A * 3/1998 Saito et al. ..... 347/104
5,971,534 A 10/1999 Sasaki et al.
6,250,750 B1 6/2001 Miyazawa et al.
7,275,809 B2 * 10/2007 Uwagaki et al. ..... 347/49

* cited by examiner

*Primary Examiner*—Anh T. N. Vo
(74) *Attorney, Agent, or Firm*—Rabin & Berdo, P.C.

(57) ABSTRACT

An ink cartridge and loading mechanism for ink cartridge are provided. A mounting structure is formed on one side of the ink cartridge. The loading mechanism includes a loading section, a gear set, and a lever set. The loading section has lateral walls and a deck. The gear set is located on one of the lateral walls and has a spur gear and a pinion gear engaged to each other. The spur gear has at least one protrusion inserted into the mounting structure of the ink cartridge. The lever set is connected to the pinion gear for driving the gear set. Therefore, the gear set may change the torque of the protrusion. Then the protrusion may be coupled with the mounting structure to suppress the ink cartridge downward, or to lift the ink cartridge to be removed.

16 Claims, 11 Drawing Sheets

INK CARTRIDGE AND LOADING MECHANISM FOR INK CARTRIDGE

CROSS-REFERENCE TO RELATED APPLICATIONS

This non-provisional application claims priority under 35 U.S.C. § 119(a) on Patent Application No(s). 094136967 filed in Taiwan, R.O.C. on Oct. 21, 2005, the entire contents of which are hereby incorporated by reference.

BACKGROUND OF THE INVENTION

1. Field of Invention

The invention relates to an ink cartridge and its loading mechanism. In particular, the invention relates to an ink cartridge loading mechanism that utilizes a gear set to change the torque, thereby changing the force on the ink cartridge.

2. Related Art

The ink cartridge loading mechanisms of the inkjet printers can be roughly divided into two types. One type uses a transmission mechanism, such as a guiding screw rod or a belt, to drive the loading mechanism and the ink cartridge thereon to perform a reciprocal motion along a horizontal axis. The paper to be printed is driven by a paper feeding mechanism to pass under the ink cartridge in the vertical direction. The print head ejects ink inside the ink cartridge onto the surface of the paper. The other type uses a fixed loading mechanism. The nozzle array of a print head whose width is larger than or equal to the width of the paper to be printed is employed to directly print on the paper; therefore, the width of the ink cartridge is almost the same as that of the nozzle array of the print head in this mode. In addition, when it is used in color printing models, the ink cartridge usually contains multiple replaceable ink reservoirs for storing inks of different colors, so the page-width array type of ink cartridge has a larger size and more weight. In the above-mentioned two types of inkjet printing mechanisms, the print heads can be integrated in the ink cartridge. Alternatively, they may be separately installed at the bottom of the loading mechanism and connected to the ink cartridge.

The ink cartridges have to be fixed on the loading mechanism to maintain its stability during the printing process and print at correct places. However, they are regularly replaced for ink replenishment. Therefore, the loading mechanism has to provide a good mounting mechanism for fixing and rapid replacement. U.S. Pat. No. 5,971,534 provides an ink cartridge loading mechanism. It mainly includes a receptacle section and a hood section. The ink cartridge is disposed in the receptacle section. With the combination of the rack and pinion, the receptacle section and the ink cartridge are driven to move. The hood section covers one side of the receptacle section and the ink cartridge, so that the ink cartridge does not depart from the receptacle section. U.S. Pat. No. 6,250,750 disposes the ink cartridge in a receptacle section and covers it with a hood which is disposed on an opening of the receptacle section. The hood also suppresses the top of the ink cartridge, thus fixing the ink cartridge in the receptacle section. The mechanism further includes an arm in connection with the hood. As the hood is opened, the print head is lifted from below by the arm for replacement. However, the above-mentioned techniques utilize a stopping-type fixing structure in which a fixing force is limited. For a movable ink cartridge and its loading mechanism, the width of the ink cartridge is small, so the relative size and weight are small and light in weight; therefore, the fixing force is still satisfactory. However, for a page-width array ink cartridge, the fixing force will be insufficient. Currently, most of the page-width array ink cartridges are fixed by screws. This makes replacement very inconvenient.

SUMMARY OF THE INVENTION

The conventional ink cartridge makes use of a simple fixing mechanism to provide the fixing force on the ink cartridge. Such a force is insufficient for ink cartridges with larger sizes and weights. In view of the foregoing, the invention provides an ink cartridge and loading mechanism for the ink cartridge that uses a gear set to change a torque for strengthening the fixing effect. It also has the function of lifting the ink cartridge for the convenience of taking out the ink cartridge.

To achieve the object, the invention discloses an ink cartridge and loading mechanism for the ink cartridge. The lateral walls of the ink cartridge are provided with a mounting structure. The mounting structure has at least a horizontal positioning rib. The loading mechanism includes loading section, a gear set, and a lever set.

The loading section has lateral walls and a deck for supporting the ink cartridge.

The gear set is disposed on a lateral wall and has a spur gear and a pinion gear. The spur gear is formed with two protrusions on above and below the positioning rib respectively.

The lever set is connected to the pinion gear for rotating the gear set. By changing the rotating direction of the spur gear, one of the protrusions suppresses the ink cartridge downward from the top of the positioning rib or the other protrusion lifts the ink cartridge upward from the bottom of the positioning rib for taking out the ink cartridge. The lever set and the lateral walls of the loading section are further provided with a positioning structure for fixing the position of the lever set. When the protrusion suppresses down and fixes the ink cartridge, the position of the lever is fixed. Therefore, the position of the ink cartridge is secured.

The gear set of the invention provides a deceleration ratio to change the torque relation between the protrusion and the lever set. The torque produced by the lever set is magnified to enhance the suppressing or lifting force on the ink cartridge. The fixing effect of the positioning structure is also enhanced to fix the position of the lever set; therefore, the ink cartridge is thus secured on the loading section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
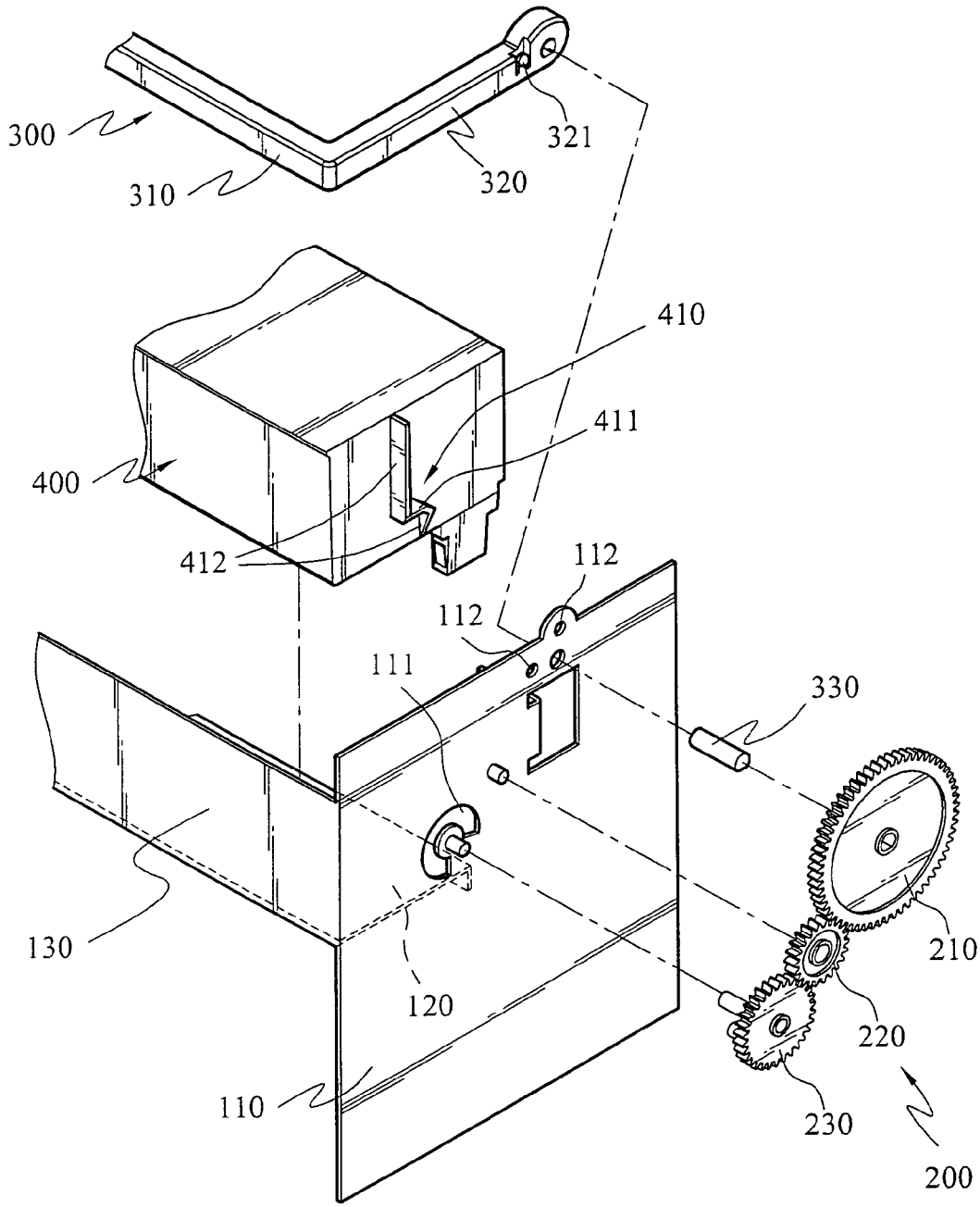
FIG. 1 is an exploded view of local devices in the first embodiment of the invention.
Figure 2:
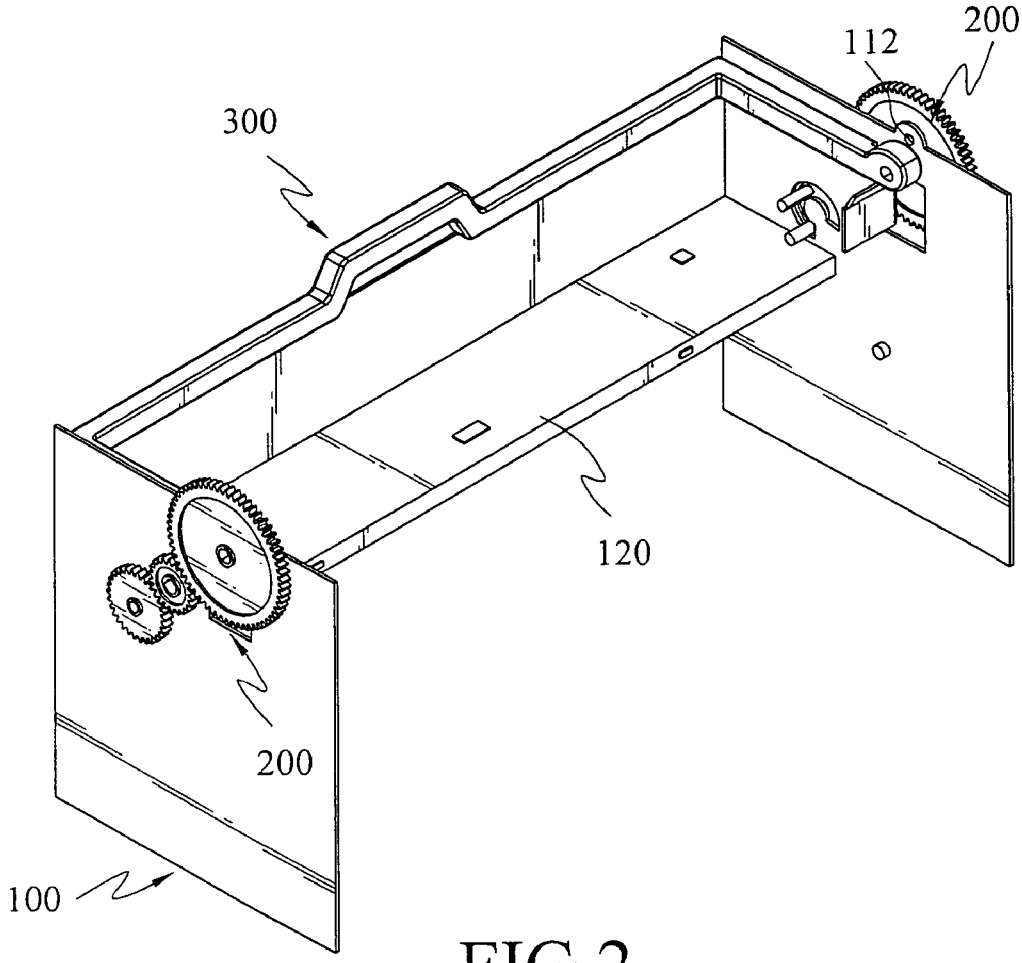
FIG. 2 is a three-dimensional view of the loading mechanism in the first embodiment.
Figure 3:
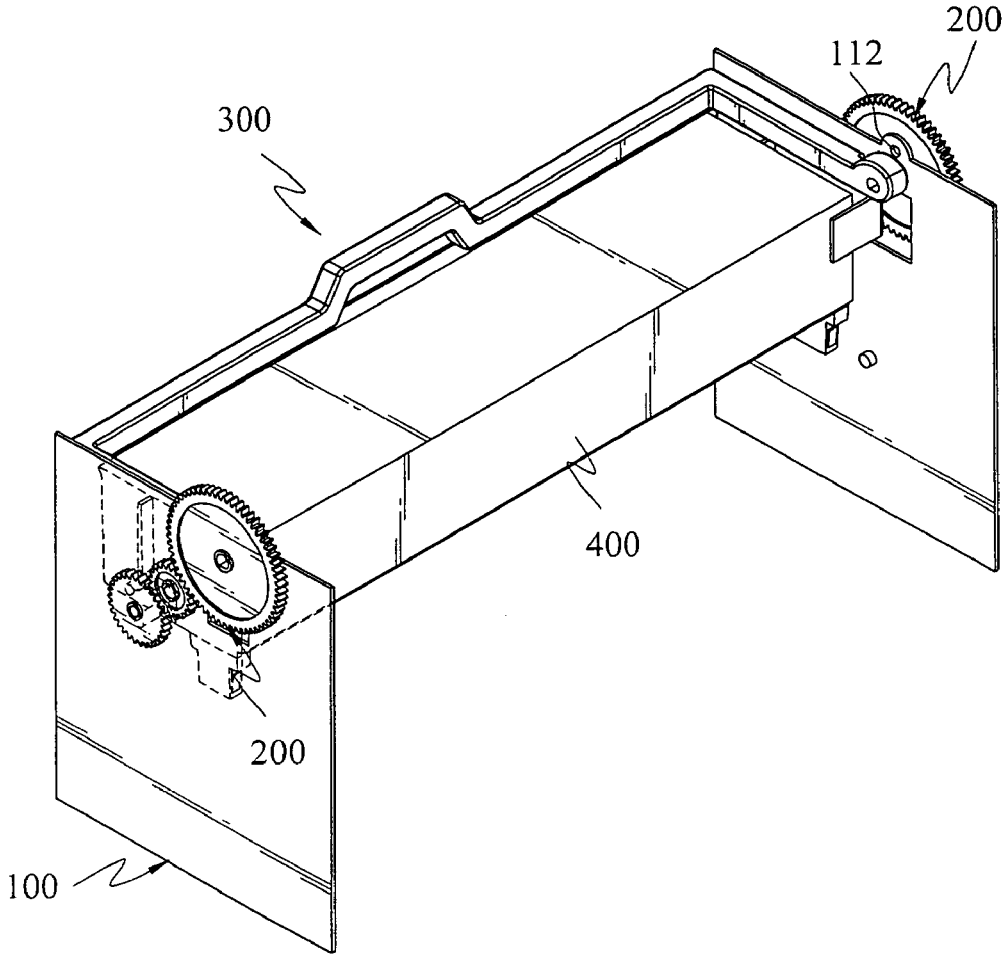
FIG. 3 is a three-dimensional view of the ink cartridge and loading mechanism in the first embodiment.

Please refer to FIGS. 1 to 3. The loading mechanism for ink cartridge according to a preferred embodiment of the invention includes a loading section 100, two gear sets 200 and a lever set 300. The loading section 100 has two opposite lateral walls 110, a deck 120, and a front wall 130 to form a receptacle section for containing an ink cartridge 400. The gear sets 200 are disposed on the outer sides of the two lateral walls 110 of the loading section 100. The ink cartridge 400 may be fixed or lifted from both sides thereof. The lever set 300 is engaged with the gear sets 200 for the user to drive the gear sets 200 into motion; thereby the gear sets 200 fixing or lifting the ink cartridge 400 in the loading section 100. The two sides of the ink cartridge 400 form a mounting structure 410, which has a positioning rib 411 and two limiting ribs 412. The positioning rib 411 remains horizontal, while the two limiting ribs 412 are respectively connected to the two ends of the positioning rib 411 and vertical to the positioning rib 411. The above description shows the rough composition of the invention. The detailed structures are described as follows.

The loading section 100 may be an independent design. It is disposed in the printer via an opening on the printer shell. Alternatively, it may be integrated as a part of the printer, such as a recessed loading section 100 directly formed on the printer shell.

The gear set 200 includes one pinion gear 210, at least one transmission gear 220, and one spur gear 230 pivotally installed on an outer surface of the lateral wall 110. The pinion gear 210 is engaged with the lever set 300. The lever set 300 inputs an external force to rotate the gear set 200. The transmission gear 220 is disposed between the pinion gear 210 and the spur gear 230 for changing the relative rotating direction between them, and for producing a speed ratio to change the rotating torque and rotating speed of the spur gear 230. The number of transmission gears 220 is not limited to one. There may be several transmission gears 220 of different sizes in combination to render an optimal speed ratio. The relative rotating direction between the pinion gear 210 and the spur gear 230 is changed according to requirements. The transmission gear 220 may be removed, so that the pinion gear 210 and the spur gear 230 are directly engaged.

Figure 4:
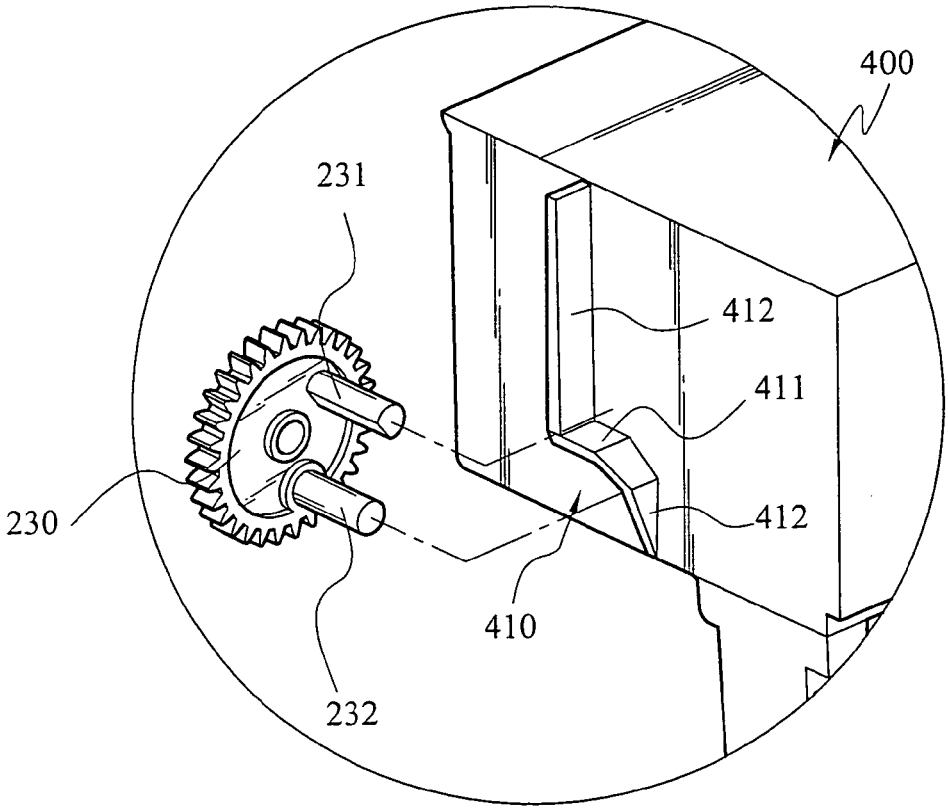
FIG. 4 is an exploded view of local devices in the first embodiment, showing the relation between the protrusions and the mounting structure.
Figure 5:
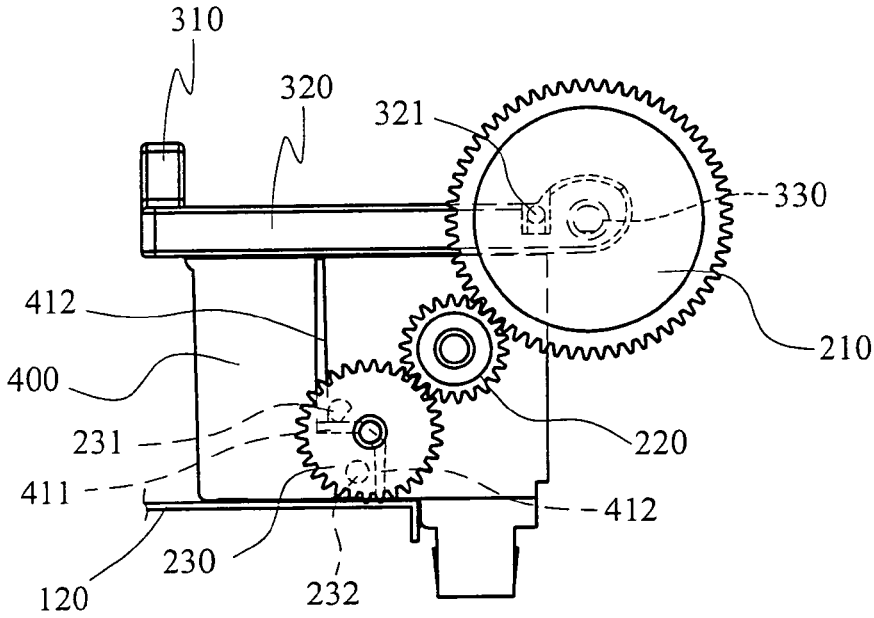
FIG. 5 is a side view of the first embodiment, showing the relation among the spur gear, the positioning rib, and other devices.
Figure 6:
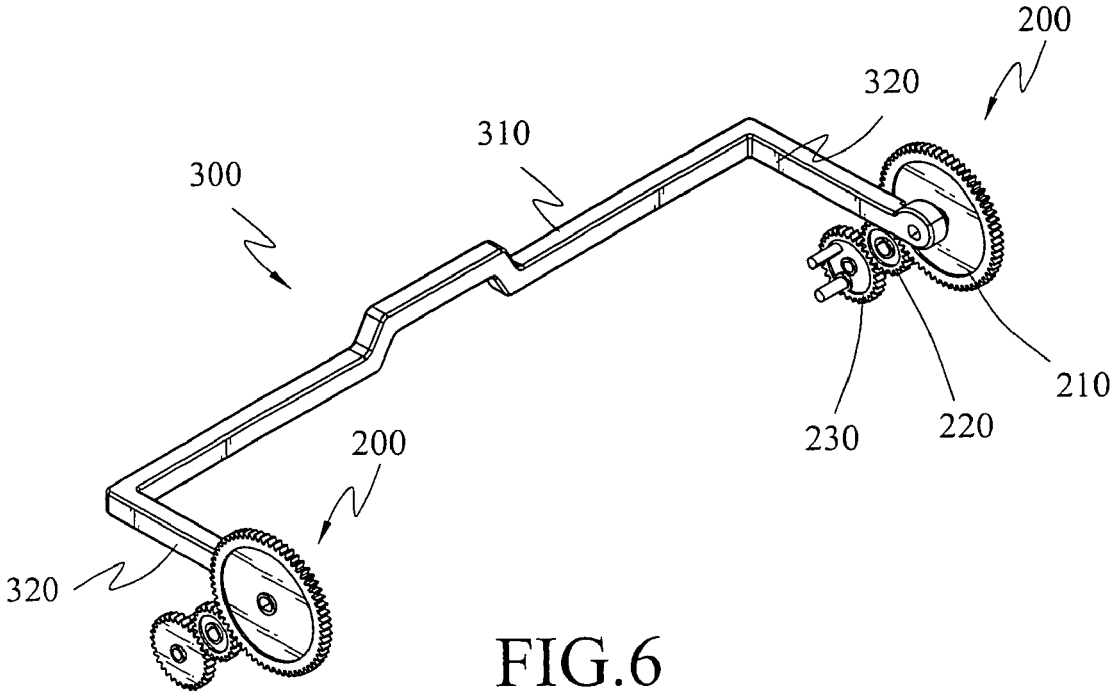
FIG. 6 is a three-dimensional view of local devices in the first embodiment, showing the relation between the lever set and the gear sets.

With reference to FIGS. 4 to 6, the spur gear 230 corresponds to the mounting structure of the ink cartridge 400. One side of the spur gear 230 facing the ink cartridge 400 is formed with two protrusions 231, 232, which are inserted into the inner side of the loading section 100 via through holes 111 on the lateral wall 110 and protrude in the mounting structure 410. Driven by the spur gear 230, the two protrusions 231, 232 suppress against the top or bottom of the positioning rib 411 of the ink cartridge 400. One protrusion 231 suppresses the ink cartridge 400 downward from the top of the positioning rib 411. The other protrusion 232 lifts the ink cartridge 400 upward from the bottom of the positioning rib 411 for taking out the ink cartridge.

The lever set 300 contains a pull rod 310 and two levers 320. The two levers 320 extend from both ends of the pull rod 310. They are parallel to each other and perpendicular to the pull rod 310. The other ends of the two levers 320 are fixed to one side of the two pinion gears 210 using a pin 330, respectively and pivotally installed on the lateral walls of the loading section 100 at the same time. Pulling the pull rod 310 swings the two levers 320, which then brings the pinion gear 210 into rotation. One side of the lever set 300 corresponding to the lateral wall 110 is provided with a positioning block 321. The lateral wall 110 is formed with two positioning holes 112 for the engagement of the positioning block 321. The lever 320 may be fixed at a first position or a second position.

What has been described above is the structure of the invention. The following describes the operation principle of the invention.

Figure 7A:
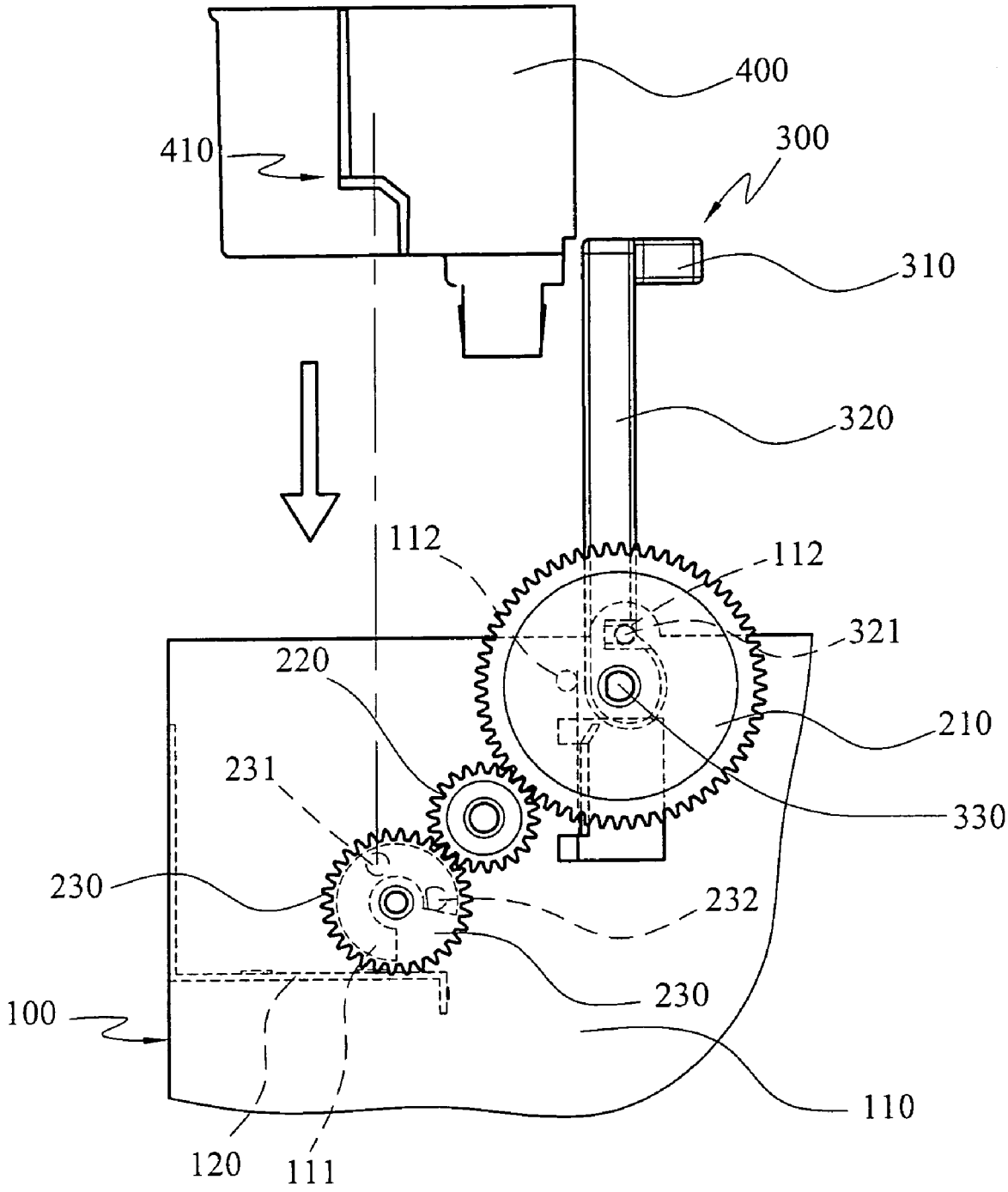
FIGS. 7A, 7B, and 7C are schematic side views of the first embodiment, showing the process of inserting and fixing the ink cartridge into the loading mechanism.
Figure 7B:
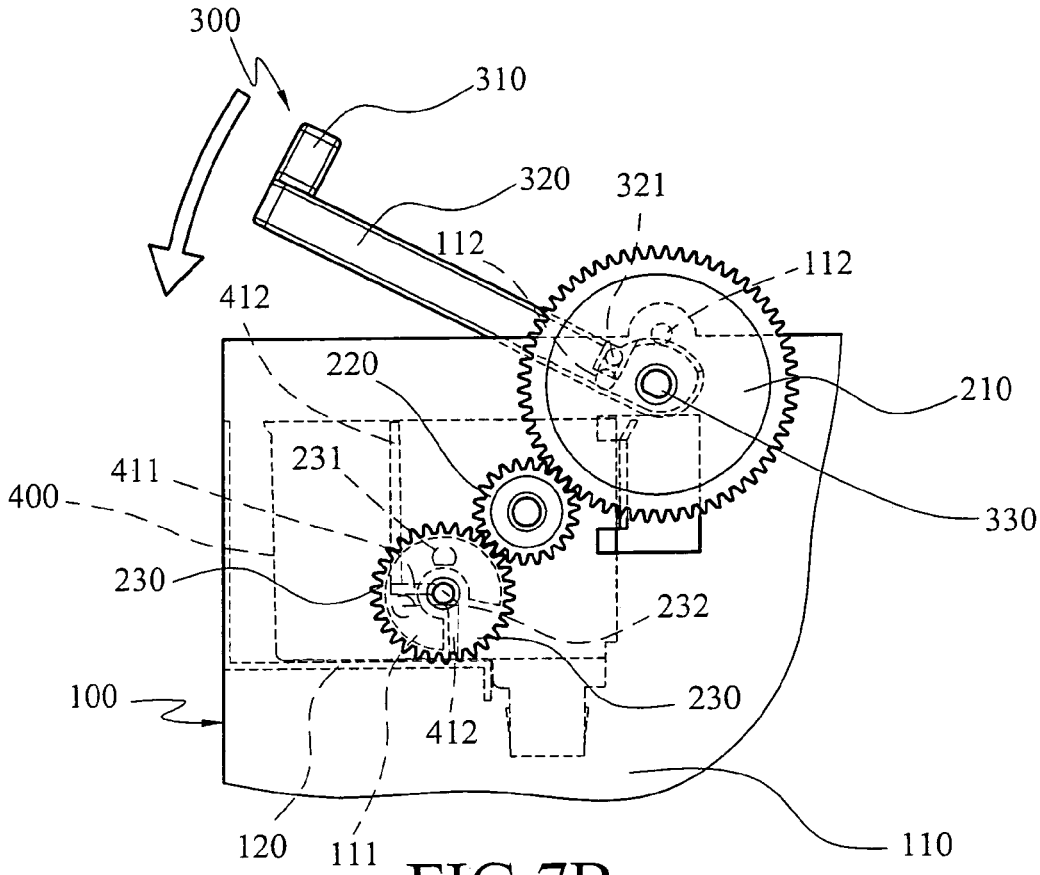
Figure 7C:
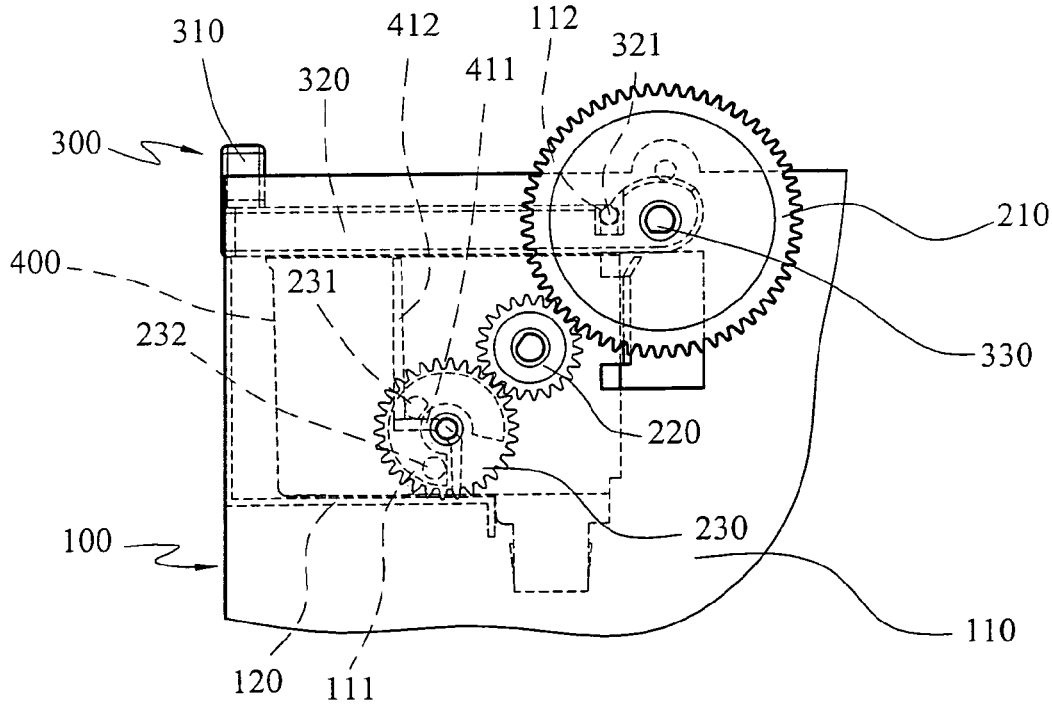

With reference to FIGS. 7A, 7B, 7C, pulling the pull rod 310 upward enables the lever 320 to rotate the gear set 200. The protrusion 231 on the upper side of the spur gear 230 is driven downward by the spur gear 230 and moved horizontally toward one side. The positioning block 321 is engaged into the positioning hole 112 corresponding to the first position. The loading mechanism of the ink cartridge is in the release state. Afterwards, the ink cartridge 400 is disposed in the loading section 100. The positioning rib 411 is aligned with the two gear sets 200, so that the lower side of the positioning rib 411 is disposed on the protrusion 232 at the lower side of the spur gear 230. The pull rod 310 is then suppressed, so that the lever 320 reverses rotating direction of the gear set 200. In this case, the upper side of protrusion 231 follows an arc path to move upward and sideways to a position above the positioning rib 411. Afterwards, the positioning rib 411 is suppressed downward, so that the ink cartridge 400 cannot depart. The limiting ribs 412 on the upper side of the positioning rib 411 provides a limiting effect to prevent the spur gear 230 from over-rotating so that the protrusion 231 has too much horizontal displacement and cannot suppress on the top of the positioning rib 411. At the same time, the positioning block 321 on the lever 320 is engaged into the positioning hole 112 corresponding to the second position. The lever set 300 and the gear set 200 are fixed so that they can not have opposite motions. The ink cartridge loading mechanism is in the fixing state. This completes the mounting operation of the ink cartridge.

The gear set 200 provides a speed ratio for changing the torque relation between the spur gear 230 and the pinion gear 210. It is used to magnify the torque of the lever 320 and to enhance the suppressing force of the protrusion 231. At the same time, the departing force of the ink cartridge 400 due to the wiggling of an external force is reduced by the speed ratio. Therefore, the combination between the positioning block 321 and the positioning hole 112 is enhanced. The lever set 300 is thus secured in the second position and kept in the mounting state.

Figure 8A:
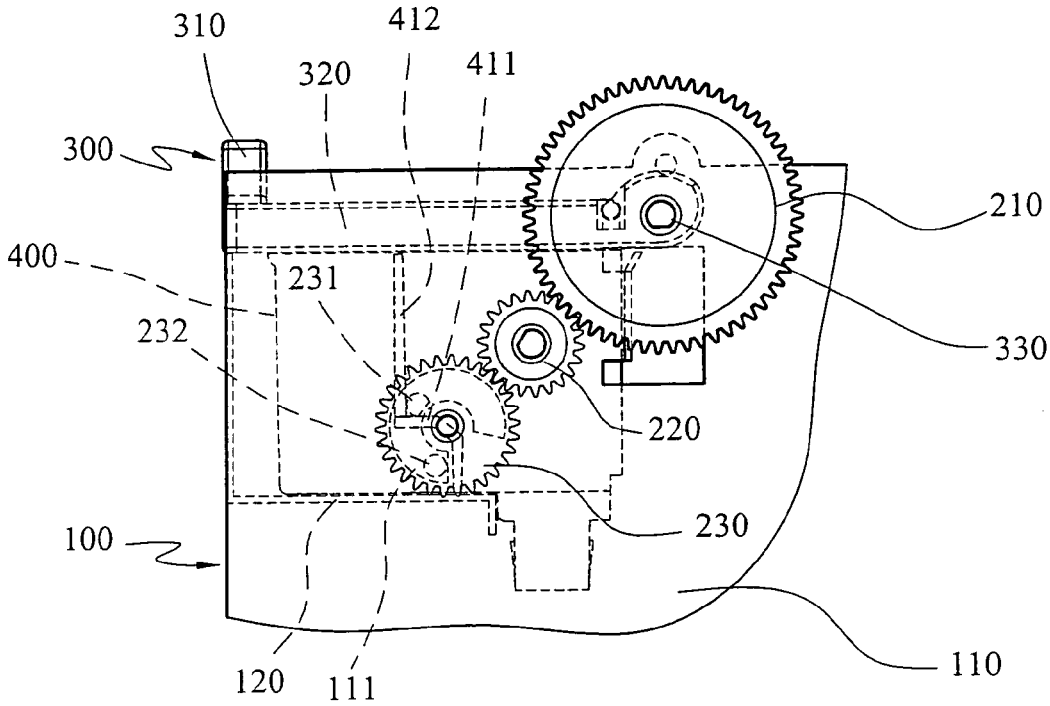
FIGS. 8A, 8B, and 8C are schematic side views of the first embodiment, showing the process of releasing the ink cartridge from the loading mechanism.
Figure 8B:
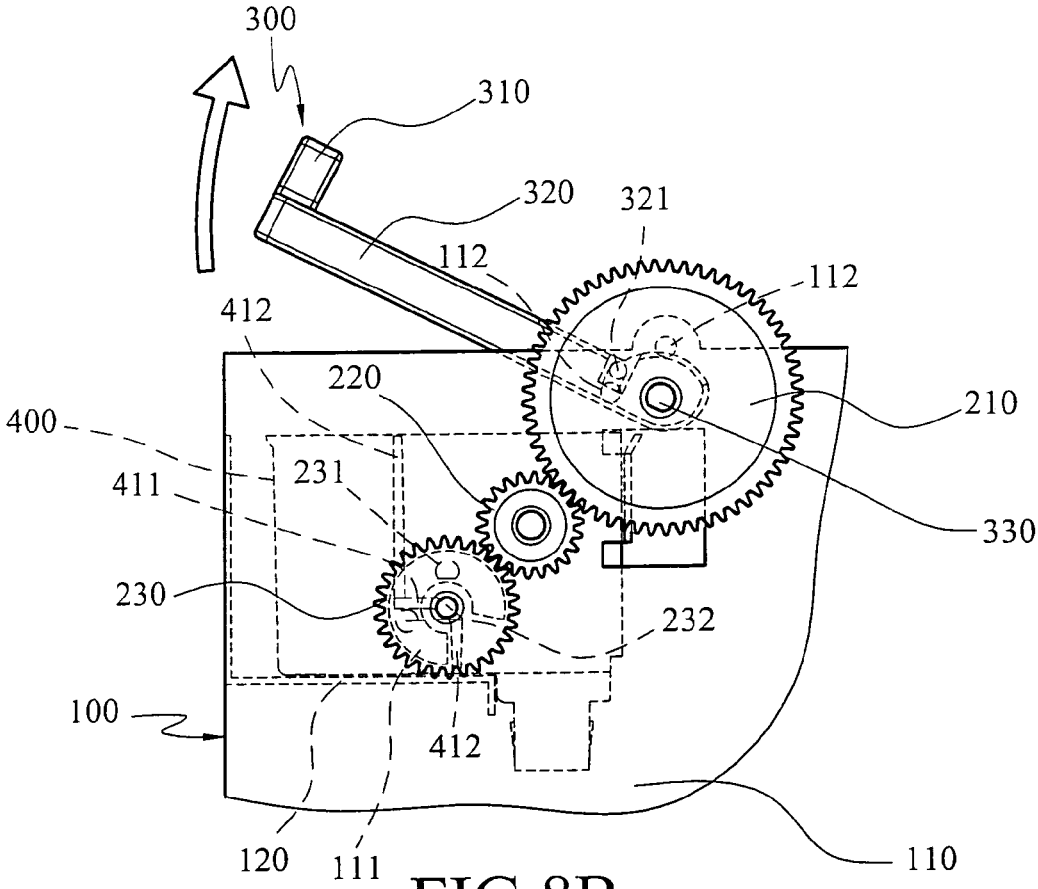
Figure 8C:
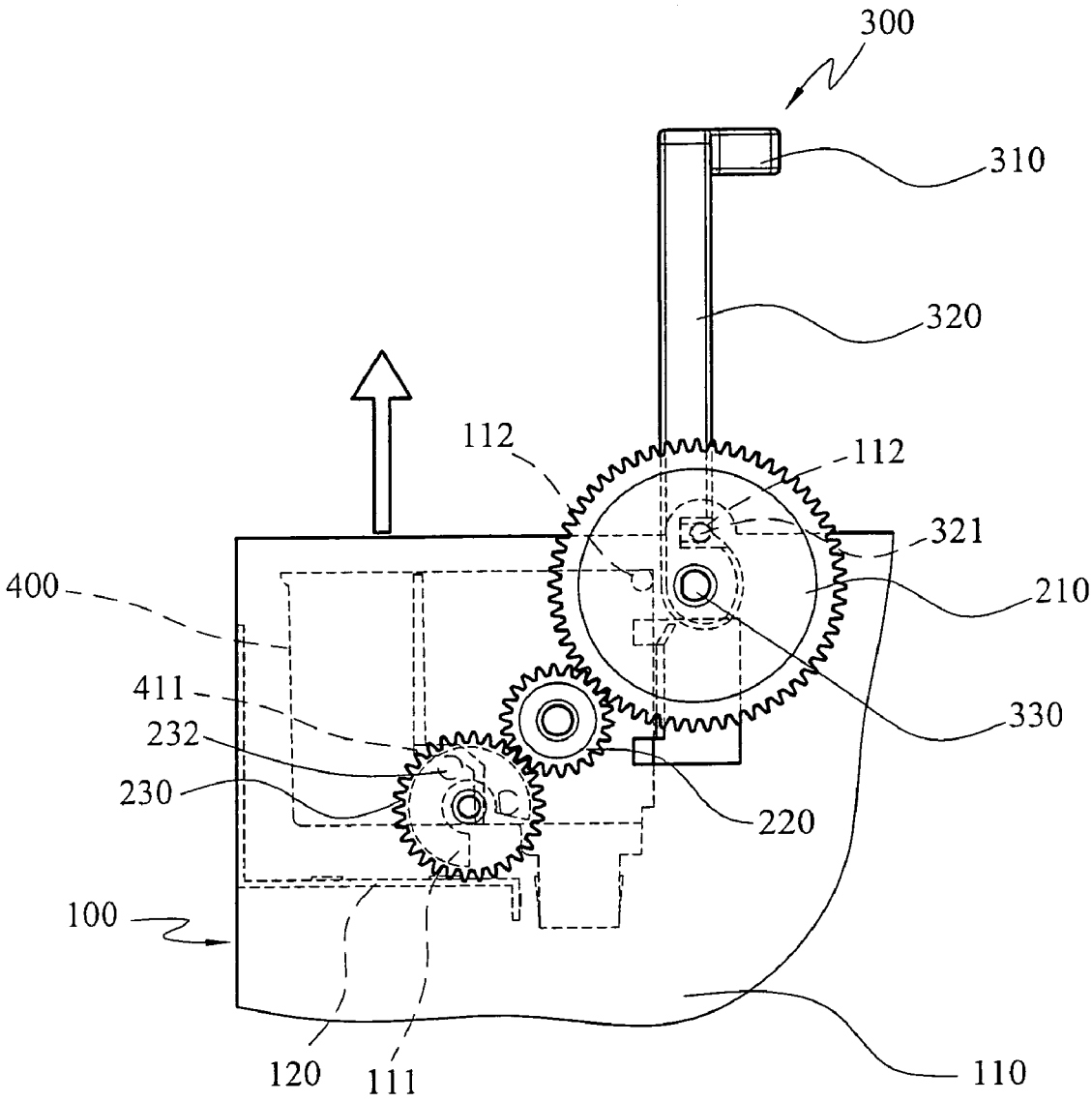

Please refer to FIGS. 8A to 8C. To take out the ink cartridge 400, the pull rod 310 is pulled so that the positioning block 321 leaves the positioning hole 112. The lever 320 brings the pinion gear 210 into rotation (counterclockwise in the drawing). In this case, the spur gear 230 produces a counterclockwise rotation to lift the protrusion 231 suppressing on the positioning rib 411 and to move it sideways to one side of the positioning rib 411. The ink cartridge 400 is thus released. At the same time, the other protrusion 232 is lifted by the spur gear 230 to touch against the lower side of the positioning rib 411 and to push the ink cartridge 400 upward. The ink cartridge 400 is then lifted to allow the user to easily remove it. The limiting rib 412 under the positioning rib 411 has a limiting effect on the protrusion 232 to prevent the protrusion 232 from over displacement, such as to prevent the protrusion 232 from moving out from below of the positioning rib 411, which will cause the ink cartridge 400 to fall down. In this case, the positioning block 321 is engaged into the other positioning hole 112, fixing the position of the lever set 300. The ink cartridge loading mechanism is fixed in the release state to prevent the replacement of the ink cartridge 400 from interference.

In addition to fixing and lifting the ink cartridge, the disclosed loading mechanism for ink cartridge may be used to release a circuit board too. During the operation of the ink cartridge, the printer provides a pulse voltage according to the printing job to the inkjet mechanism for ejecting the ink. The supply of the pulse voltage requires the connection of a circuit board and an ink cartridge. The ink is then supplied to the inkjet printing mechanism, such as the heater of a thermal bubble print head or the piezoelectric material of the piezoelectric print head, at the print head. Since the ink cartridge has to be regularly removed and replaced, the electrical connection between the ink cartridge and the circuit board uses touch electrodes. The ink cartridge and the circuit board touch against each other for the electric connection.

A second embodiment of the invention provides a loading mechanism for ink cartridge. In addition to effectively mounting the ink cartridge and enabling rapid installation and replacement, the loading mechanism can automatically release the circuit board while taking out the ink cartridge without any additional procedure.

Figure 9:
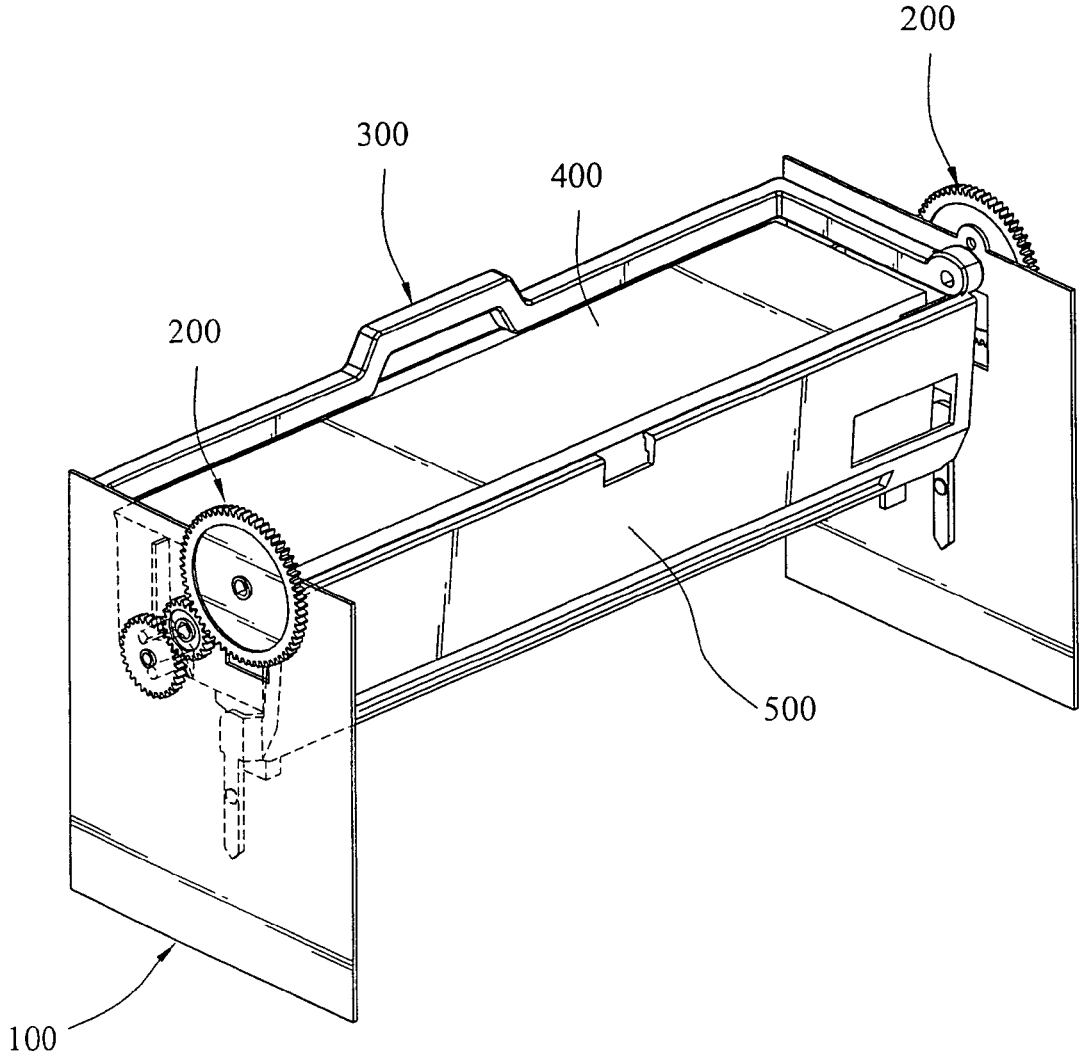
FIG. 9 is a three-dimensional view of the second embodiment of the invention.
Figure 10A:
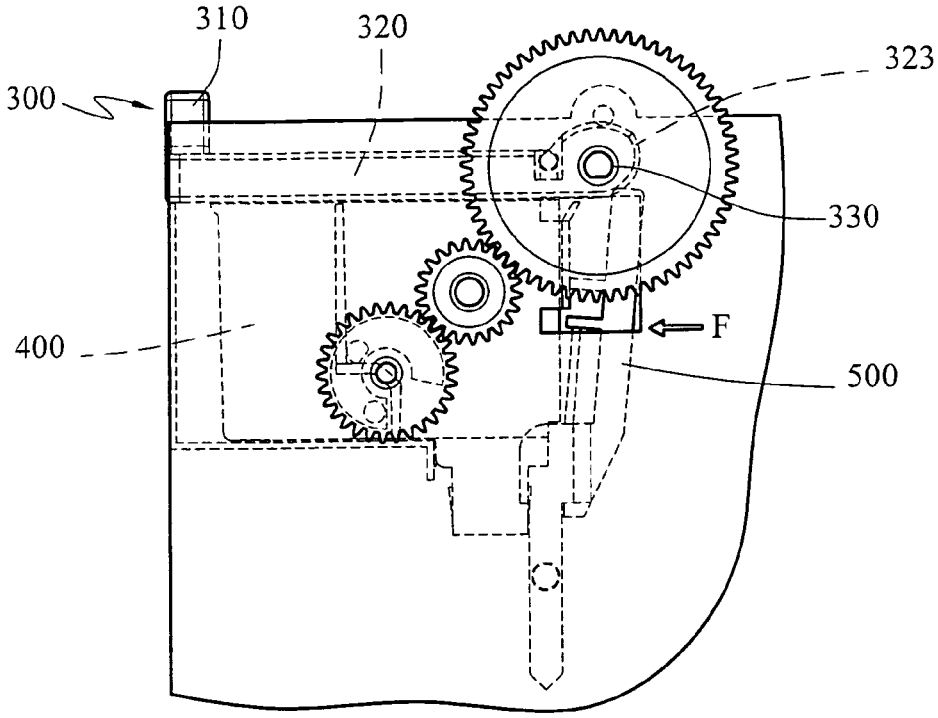
FIGS. 10A and 10B are side views of the second embodiment, showing the process of releasing the ink cartridge from the loading mechanism.
Figure 10B:
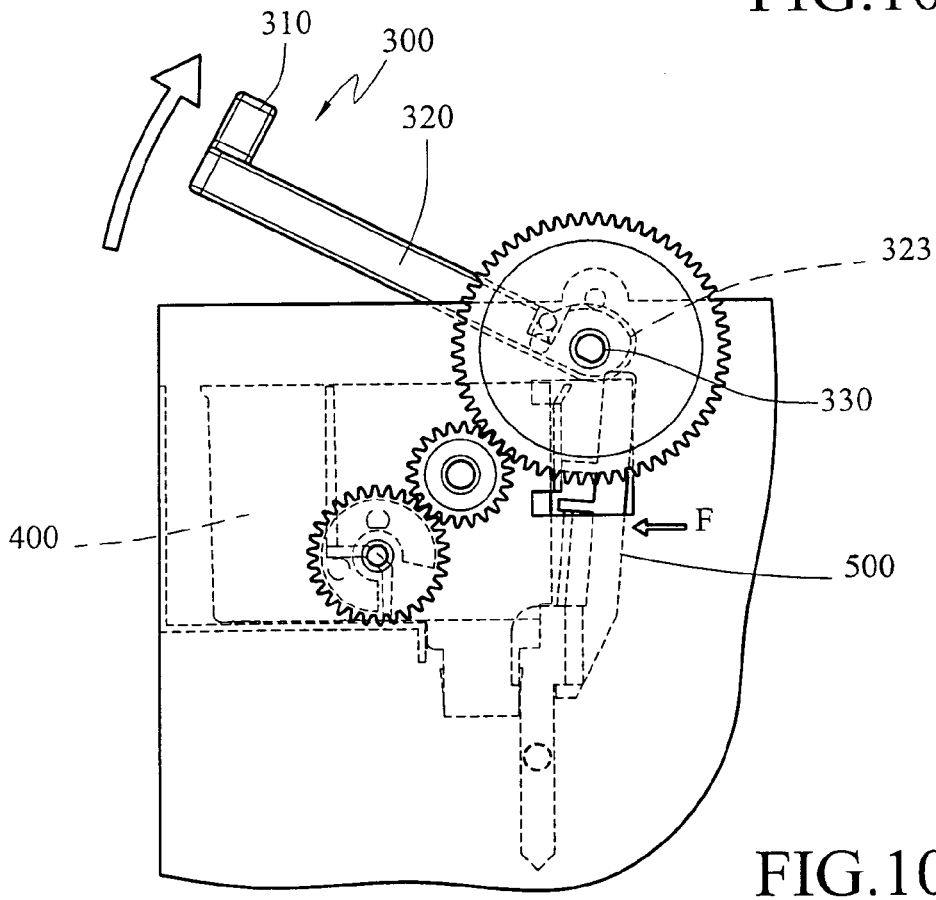

With reference to FIG. 9, FIG. 10A, and FIG. 10B, the loading mechanism for ink cartridge according to the second embodiment of the invention includes a loading section 100, two gear sets 200, a lever set 300, and a circuit board 500. The loading section 100 has a receptacle section to accommodate an ink cartridge 400. The gear sets 200 are respectively installed on the outer sides of the two lateral walls 110 of the loading section 100. The ink cartridge 400 may be fixed or lifted from both sides. The lever set 300 has a pull rod 310 and two levers 320. One end of each lever 320 is connected to one gear set 200 using a pin 330 and pivotally installed on one lateral wall of the loading section 100. Therefore, the lever 320 swings to bring the gear sets 200 into rotation.

The end of the lever 320 pivotally installed on the lateral wall of the loading section 100 is formed with a protruding wheel 323. The circuit board 500 is pivotally installed on a side with contact electrodes, corresponding to the ink cartridge 400, inside the loading section 100. The circuit board 500 uses an elastic force F produced by an elastic device to constantly push itself toward the ink cartridge 400. The protruding wheel 323 suppresses against one side of the circuit board 500. When the lever 320 is in the first position, the loading mechanism is in the mounting state. The protruding wheel is in contact with the border of the circuit board 500 by its lower point. In this case, the circuit board 500 receives the elastic force F produced constantly by the elastic device and touches against the lateral wall of the ink cartridge 400, letting the contact electrodes conduct as in FIG. 10A. When the lever set 300 is lifted to the second position, the loading mechanism for ink cartridge is in the release state. The top point of the protruding wheel 323 pushes the circuit board 500 outward, departing the circuit board 500 from the ink cartridge 400 as in FIG. 10B. In this case, the ink cartridge 400 is simultaneously released and lifted for the user to take out directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A loading mechanism for accommodating ink cartridge in which one side has a mounting structure, comprising:

a loading section having at least one lateral wall; and a gear set disposed on the lateral wall and having at least a spur gear, a pinion gear and at least one transmission gear, wherein one side of the spur gear is formed with a protrusion inserted into the mounting structure, the pinion gear is engaged with the spur gear and the rotation of the pinion gear drives the spur gear into rotation, and the transmission gear is disposed between the pinion gear and the spur gear to change the speed ratio and relative rotating direction between the spur gear and the pinion gear; wherein the gear set drives the protrusion to suppress the ink cartridge downward or to lift the ink cartridge upward via the mounting structure.

2. The loading mechanism of claim 1 further comprising a lever engaged with the pinion gear so that the lever swings to drive the pinion gear into rotation.

3. The loading mechanism of claim 2 further comprising a pull rod, wherein the lever extends from one end of the pull rod and the other end of the lever is fixed on the pinion gear.

4. The loading mechanism of claim 2, wherein one side of the lever corresponding to the lateral wall is formed with a positioning block and the lateral wall is formed with at least one positioning hole for the engagement of the positioning block, fixing the lever in a predetermined position.

5. The loading mechanism of claim 1 further comprising a circuit board pivotally installed on the loading section, wherein an elastic device produces an elastic force to constantly push the circuit board toward one direction.

6. The loading mechanism of claim 5 further comprising a lever engaged with the gear set, wherein one end of the lever is formed with a protruding wheel touching against the circuit board, and the lever swings to drive the gear set into rotation and to drive the protruding wheel to touch against the circuit board as well.

7. The loading mechanism of claim 1, wherein one side of the spur gear is formed with two protrusions inserted into the mounting structure for suppressing the ink cartridge downward and lifting the ink cartridge upward, respectively.

8. An ink cartridge and loading mechanism for ink cartridge, comprising:

a loading section having at least one lateral wall;

a gear set disposed on the lateral wall and having at least one spur gear in which one side is formed with two protrusions; and an ink cartridge disposed in the loading section;

wherein one side of the ink cartridge is formed with a positioning rib and the two protrusions extend to the upper and lower sides of the positioning rib, one of the protrusions is driven by the spur gear to suppress downward from above the positioning rib to fix the ink cartridge and the other protrusion is driven upward from below the positioning rib to lift the ink cartridge.

9. The ink cartridge and loading mechanism for ink cartridge of claim 8, wherein the gear set further includes a pinion gear engaged with the spur gear, wherein the rotation of the pinion gear brings the spur gear into rotation.

10. The ink cartridge and loading mechanism for ink cartridge of claim 9, wherein the gear set further includes at least one transmission gear disposed between the pinion gear and the spur gear for changing the speed ratio and relative rotating direction between the spur gear and the pinion gear.

11. The ink cartridge and loading mechanism for ink cartridge of claim 9 further comprising a lever engaged with the pinion gear, wherein the lever swings to drive the pinion gear into rotation.

12. The ink cartridge and loading mechanism for ink cartridge of claim 11, wherein one side of the lever corresponding to the lateral wall is formed with a positioning block and the lateral wall is formed with at least one positioning hole for the engagement of the positioning block, fixing the lever at a predetermined position.

13. The ink cartridge and loading mechanism for ink cartridge of claim 8, wherein one side of the ink cartridge is further formed with two limiting ribs extending from both ends of the positioning rib for limiting the horizontal displacement of the two protrusions.

14. A loading mechanism for accommodating ink cartridge in which one side has a mounting structure, comprising:

a loading section having at least one lateral wall;

a gear set disposed on the lateral wall and having at least a spur gear, and a pinion gear, one side of the spur gear being formed with a protrusion inserted into the mounting structure, the pinion gear being engaged with the spur gear and the rotation of the pinion gear driving the spur gear into rotation; and a lever engaged with the pinion gear so that the lever swings to drive the pinion gear into rotation;

wherein the gear set drives the protrusion to suppress the ink cartridge downward or to lift the ink cartridge upward via the mounting structure.

15. The loading mechanism of claim 14, further comprising a pull rod, wherein the lever extends from one end of the pull rod and the other end of the lever is fixed on the pinion gear.

16. The loading mechanism of claim 14, wherein one side of the lever corresponding to the lateral wall is formed with a positioning block and the lateral wall is formed with at least one positioning hole for the engagement of the positioning block, fixing the lever in a predetermined position.

* * * * *